US007878622B2

(12) United States Patent
Uchida

(10) Patent No.: US 7,878,622 B2
(45) **Date of Patent: *Feb. 1, 2011**

(54) INK JET RECORDING APPARATUS

(75) Inventor: Haruo Uchida, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/437,489

(22) Filed: May 7, 2009

(65) Prior Publication Data

US 2009/0213171 A1 Aug. 27, 2009

Related U.S. Application Data

(63) Continuation of application No. 11/082,354, filed on Mar. 17, 2005, now Pat. No. 7,547,089.

(30) Foreign Application Priority Data

Mar. 23, 2004 (JP) ..... 2004-084452

(51) Int. Cl.
*B41J 2/165* (2006.01)

(52) U.S. Cl. ..... 347/30

(58) Field of Classification Search ..... None
See application file for complete search history.

(56) References Cited

U.S. PATENT DOCUMENTS 7,547,089 B2 * 6/2009 Uchida ..... 347/30
2001/0026299 A1 10/2001 Tsujimoto

FOREIGN PATENT DOCUMENTS

JP 2000-238286 9/2000
JP 2001-341328 12/2001

* cited by examiner

*Primary Examiner*—Manish S Shah
*Assistant Examiner*—Alexander C Witkowski
(74) *Attorney, Agent, or Firm*—Canon USA Inc IP Div

(57) ABSTRACT

An ink jet recording apparatus incorporating a plurality of ink tanks that is independently exchangeable. An amount of ink suction for a suction recovery operation is changed and controlled based on the ink tank being exchanged. In this way, a small-sized apparatus operating at a low running cost is possible by saving and decreasing the ink amount discharged by controlling the ink discharge more than necessary during the suction recovery process after exchanging the ink tank.

6 Claims, 11 Drawing Sheets

INK JET RECORDING APPARATUS

CROSS-REFERENCE TO RELATED APPLICATIONS

This application is a continuation of U.S. patent application Ser. No. 11/082,354 filed Mar. 17, 2005, which claims priority from Japanese Patent Application No. 2004-084452 filed on Mar. 23, 2004, all of which are hereby incorporated by reference herein in their entirety.

BACKGROUND OF THE INVENTION

1. Field of the Invention

The present invention relates to an ink jet recording apparatus for recording onto a recording material by discharging ink from a recording unit.

2. Description of the Related Art

A recording apparatus can be a type having components such as an image scanner, a facsimile, a copying machine, and a printer. The recording apparatus can be a type which is used as a compound type electronic device such as computer or word-processor, or which is used as an output device such as work station. These recording apparatuses record (print) images, characters, and symbols onto a recording material (a recording medium) such as thin plastic and paper, based on recording information. For example, an ink jet recording apparatus performs recording by discharging ink from minute discharge ports of a recording head of a recording unit. If the ink jet recording apparatus is left standing for a prolonged period of time, ink viscosity can increase, dye concentration can increase, or adhesion is generated, due to evaporation of the volatile components of the ink from the discharge ports.

Moreover, a discharge failure of the ink may occur due to air bubble inclusions inside the recording head upon exchanging a detachable ink tank, or due to the bubbles clotting inside the ink flow duct of the recording head. To avoid such inconveniences due to the air bubble generation or the ink property deterioration, the discharge ports of the recording head are sealed by a cap, and then a suction unit installed inside the recording apparatus depressurizes inside the cap by using a pump to suck the air bubbles out together with the ink.

The pumps used can be a tube pump and a piston pump. The tube pump generates negative pressure which is effective inside the cap, by using a restorative force of the stroked tube by a roller. The amount of suction is changed by changing the stroking amount of the tube pump. The strength of the negative pressure is changed by changing the stroking speed of the tube pump. The piston pump generates negative pressure in the depressurized chamber connected to a cap by the stroke movement of the piston inside the cylinder. If the piston reaches the suction nozzles, the depressurized chamber is connected to the cap, and the negative pressure is induced inside the cap. The piston pump instantaneously gives a large effective negative pressure. However, in general, because the suction amount of one stroke is determined by the mechanism, in order to increase the suction amount without changing the mechanism, the strokes must be repeated.

For ink jet recording apparatuses that perform color recording or tone gradation recording, a recording head having a plurality of discharge ports (discharge orifices) that discharge various ink is used. When exchanging the ink tanks, air bubbles from the connecting unit may be introduced into the ink flow duct of the recording head. These air bubbles impede normal discharge of the ink. Upon exchanging the ink tank, a suction recovery process is performed after exchanging the ink tank, so that the air bubbles are expelled along with the ink.

Nevertheless, as for the suction recovery process of the recording head having a plurality of discharge ports as in color recording, in the case of sucking the colored ink out from the three colored ink discharge ports of cyan (C), magenta (M) and yellow (Y), these three colored ink discharge ports are capped by a single cap for performing suction, and because the ink having the worst condition among the three colored ink of cyan, magenta, and yellow had been set as the standard suction recovery condition, the following technical problems may result.

That is, the suction operation after the ink tank exchange assumes the worst condition of bubbles being incorporated in the ink flow duct, that is, the assumption is being made that the ink flow duct is totally replaced by air, so that an amount of ink which is almost equivalent to a volume of the ink flow duct is set for suction. In this case, the volume equivalent to the ink suction amount is set to an ink flow duct (for example, yellow ink flow duct) having the largest volume among the three colored ink. Because of this, the conditions of suction operation is set to a maximum amount of ink suction among the three colors, whereby the maximum amount of ink suction equals to three times the yellow ink flow duct volume (for three colors).

Because of this, if the yellow ink tank is being exchanged, an appropriate suction amount is set. However, if the cyan or magenta ink tank is being exchanged, the suction amount is more than the necessary amount so that the ink is wasted. Because of this, a number of recording materials for recording are over-consumed. Moreover, due to the increase in the ink discharge amount, the cost of a process component for recycling and maintaining the waste ink is increased. At the same time, if a light color ink is added for the purpose of high resolution, there is going to be a further increase in the difference in each of the ink flow duct volumes with the construction of integrally capping these discharge ports, and the ink discharge amount is further increased.

Moreover, in case of sucking from a plurality of discharge ports having different diameters via the integral cap, because a discharge port of the worst condition is set as a standard suction amount, which means that a discharge port of small discharge port diameter having a large flow resistance is set as the standard suction condition. In this case also, the suction amount is appropriate if the ink tank with a small discharge port diameter is being exchanged. However, if the ink tank with a large discharge port diameter is being exchanged, the suction amount is excessive, so that the ink is wasted.

Moreover, in case of sucking from a plurality of discharge ports having different ink compositions via the integral cap, the ink having the worst condition is set as a standard suction amount, which means that the ink having the worst condition influencing the flow resistance such as ink viscous resistance is set as the standard suction condition. In this case also, the suction amount is appropriate if the ink tank with a large flow resistance (viscous resistance) is being exchanged. However, if the ink tank with a low flow resistance is being exchanged, the suction amount is excessive, so that the ink is wasted.

Likewise, in case of sucking from a plurality of discharge ports containing the dye ink discharge ports and the pigment ink discharge ports via the integral cap, the ink having the worst condition influencing the ink flow resistance such as ink viscous resistance is set as a standard suction condition. That is, the pigment ink having a high ink viscous resistance is set as the standard suction condition. Accordingly, in this case also, the suction amount is appropriate when the pigment ink tank is being exchanged. However, if the dye ink tank is being exchanged, the suction amount is excessive, and the ink is wasted.

SUMMARY OF THE INVENTION

The present invention is directed to an ink jet recording apparatus capable of reducing an ink discharge amount during a suction recovery operation after exchanging the ink tank. The present invention is also directed to a method for restoring ink in the ink jet recording apparatus.

In one aspect of the present invention, an ink jet recording apparatus for recording images onto a recording material by discharging ink supplied from a plurality of ink tanks is provided. The ink tanks are detachably mounted to the apparatus such that each of the plurality of ink tanks is exchangeable with another respective ink tank. The apparatus includes a recording head having a plurality of discharge port arrays communicating with the respective ink tanks and configured to discharge respective ink; a cap operable to cap the discharge port arrays; a generating unit connected to the cap and operable to generate negative pressure inside the cap capping the discharge port arrays; a detecting unit configured to detect when any of the plurality of ink tanks are being exchanged; and a controller controlling the generating unit to generate an amount of suction based on the ink tank being exchanged and detected by the detecting unit.

In another aspect of the present invention, a method for restoring ink in an ink jet recording apparatus for recording images onto a recording medium by discharging ink supplied from a plurality of ink tanks, the ink tanks being detachably mounted to the apparatus such that each of the plurality of ink tanks is exchangeable with another respective ink tank, the apparatus including a cap and a recording head having a plurality of discharge port arrays communicating with the respective ink tanks and configured to discharge respective ink, includes the following steps: a capping step of capping the discharge port arrays with the cap; a detecting step of detecting whether any of the plurality of ink tanks are being exchanged; and a changing step of changing an ink suction amount inside the cap capping the discharge port arrays based on the ink tank being exchanged and detected in the detecting step.

Other features and advantages of the present invention will become apparent to those skilled in the art upon reading of the following detailed description of embodiments thereof when taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention, and together with the description, serve to explain the principles of the invention.

DETAILED DESCRIPTION OF THE EMBODIMENTS

Hereunder, the embodiments of the present invention will be described in detail with reference to the drawings.

Figure 1:
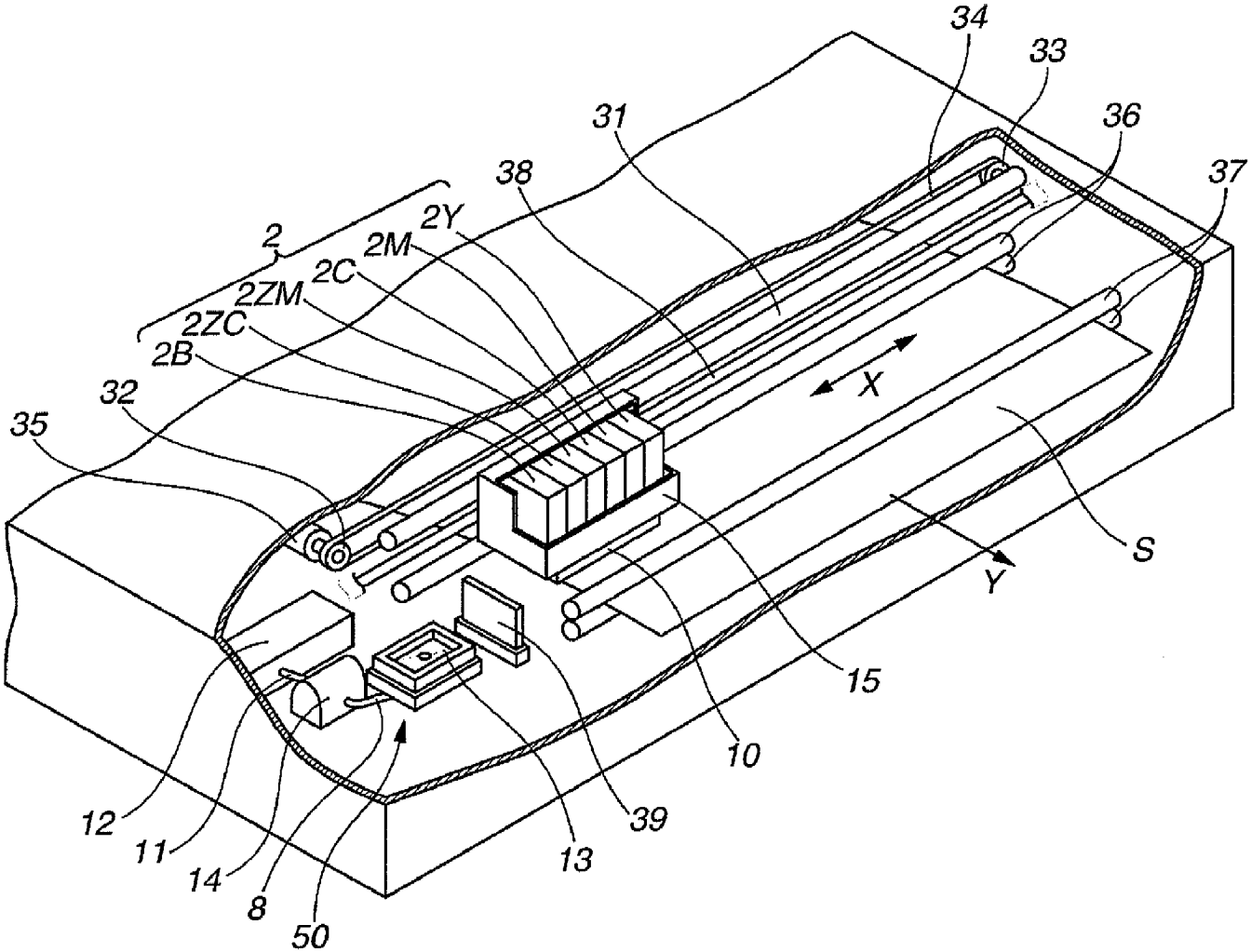
FIG. 1 is a perspective view of an ink jet recording apparatus according to one embodiment of the present invention.

FIG. 1 is a perspective view of an ink jet recording apparatus according to one embodiment of the present invention. Referring to FIG. 1, an ink jet recording apparatus includes a carriage driving mechanism for driving a carriage 15 that supports a recording head 10 as a recording unit in both directions of arrow X. The apparatus also includes a feeding mechanism (not shown) for feeding a recording material S such as a recording sheet, and a recovery apparatus 50 for maintaining and recovering an ink discharge performance of the recording head 10.

Referring to FIG. 1, the carriage driving mechanism shifts the carriage 15 that supports the recording head 10 in the main scan direction (both directions of the arrow X). The carriage driving mechanism includes a guide shaft 31 for guiding the carriage 15, a timing belt 34 which is extended from a motor pulley 32 to a follower pulley 33, and a carriage motor 35 for rotating the motor pulley 32. Then, by driving the carriage motor 35, the carriage 15 can be shifted along the guide shaft 31 via the timing belt 34.

The carriage 15 is connected to a part of the timing belt 34 conveying a driving force of the carriage motor 35. At the same time, it is slidably guided and supported in both directions of the arrow X along the guide shaft 31. It is driven along the guide shaft by a reversed or normal rotation of the carriage motor 35. An encoder strip 38 is extended throughout the main body of the apparatus, which shows an absolute position of the carriage 15 in the moving direction (both direction of the arrow X). On the other hand, at a rear face of the carriage 15 there is an encoder sensor (not illustrated) that senses the encoder strip 38. By reading a code bar of the encoder strip 38 with the encoder sensor, a position (speed) of the recording head 10 is sensed, and a standard position (for example, a home position) of the recording head 10 is detectable even if the recording operation is taking place, so that an image can be recorded to the recording material at high resolution.

The feeding mechanism feeds the recording material S in a direction of arrow Y, which intersect (for example, perpendicular to) the main scan direction. The feeding mechanism includes a pair of feed rollers 36, a pair of ejecting rollers 37 mounted downstream of the feed direction with respect to the feed rollers 36, and a feed motor (not illustrated) that drives the feed rollers 36. The feed rollers 36 and the ejecting rollers 37 are synchronously and rotatably driven, and feed the recording material S in the direction of arrow Y. The recording head 10 is mounted in position on the carriage 15.

Figure 2:
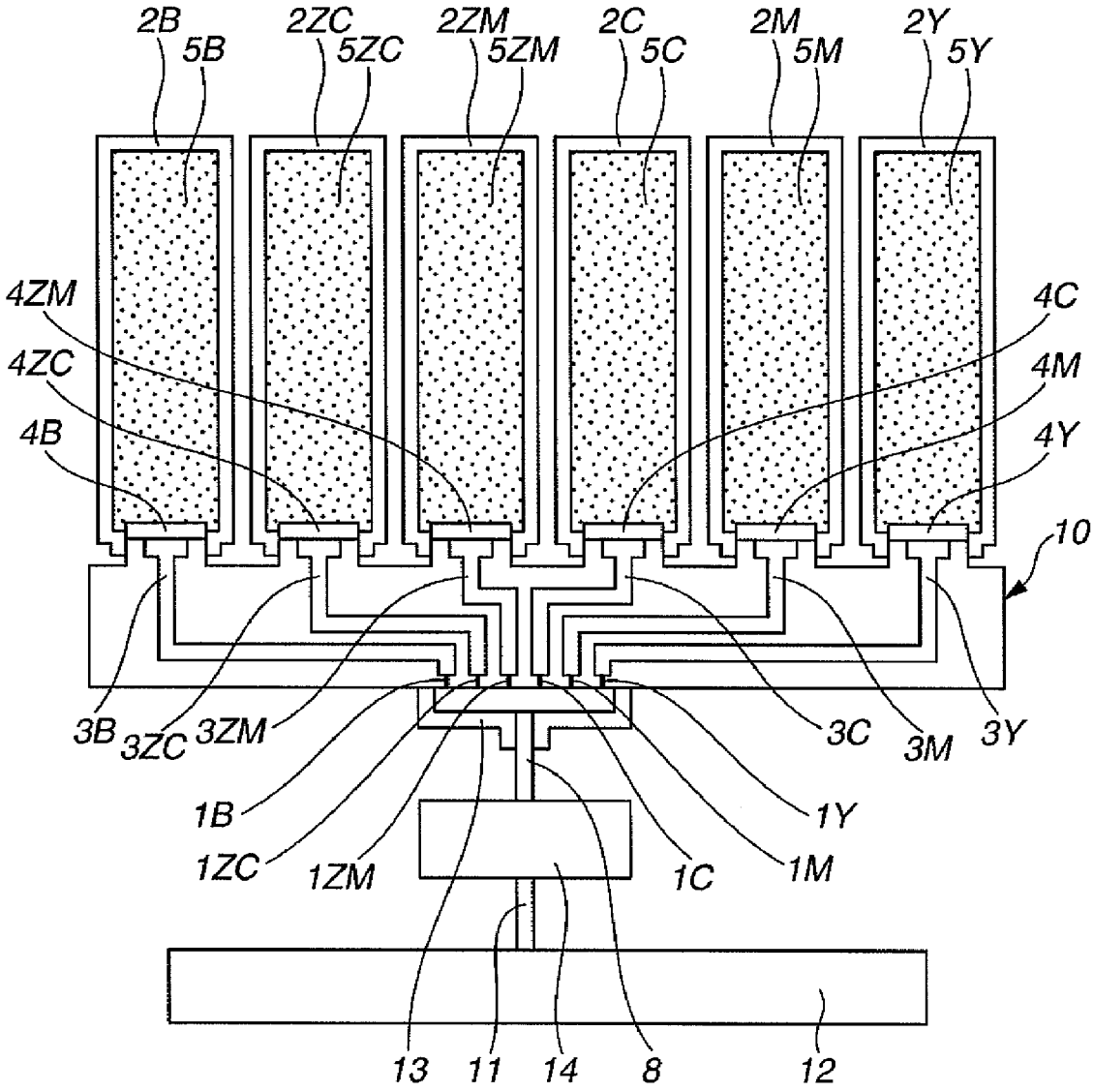
FIG. 2 is a schematic longitudinal sectional view showing the suction recovery unit in accordance with a first embodiment of the present invention.

The recording head 10, as illustrated, is for color image recording, and as shown in FIG. 2, it includes six discharge port arrays 1, each corresponding to the following colors: black ink 1B, light cyan ink 1ZC, light magenta ink 1ZM, cyan ink 1C, magenta ink 1M, and yellow ink 1Y. The discharge port arrays 1 are formed on a discharge port face of the recording head 10 opposite to the record material S. Six ink tanks (2B, 2ZC, 2ZM, 2C, 2M and 2Y) are detachably mounted to the recording head 10 corresponding to each of the six discharge port arrays 1. Further, in the explanation to follow, in the case of mounting a plurality of different color ink tanks and the discharge port arrays as required, these are distinguished by attaching a reference character B for black ink, ZC for light cyan ink, ZM for light magenta ink, C for cyan ink, M for magenta ink, and Y for yellow ink.

The plurality of discharge port arrays 1 mounted to the recording head 10, for example, include an electrothermal converting element inside each discharge port. Heat is generated by driving the electrothermal converting element to boil the ink inside the discharge port. The plurality of discharge port arrays 1 utilizes the energy generated at boiling, for discharging the ink from the discharge ports. A pulse voltage corresponding to an image signal is applied to the recording head 10 in order to selectively discharge the ink droplets from the discharge ports for recording. Ink tanks 2 are detachably mounted to the recording head 10, which contain ink that corresponds to the discharge port arrays 1. The recording head 10 and the carriage 15 implement a desired electrical connection by appropriately contacting their contact faces. The ink jet recording apparatus drives the recording head 10 based on an image signal while controlling the carriage 15 movement (the main scan), feeds a record material S, and records onto the record material S.

Referring to FIG. 1, the recovery apparatus 50 is mounted in the specified position within the carriage 15 movement region but outside the recording region. The recovery apparatus 50 as illustrated includes a capping mechanism for protecting the discharge port face where the discharge port arrays are formed, and for preventing ink evaporation from the discharge ports by covering the discharge port arrays 1 with a cap 13 if no recording is taking place; a suction recovery mechanism for sucking ink from each of the discharge port arrays by generating negative pressure inside a space of the cap by operating a suction pump 14 while the discharge port arrays are being capped; and a recovery process mechanism composed of a wiping mechanism for cleaning the discharge port face of the recording head 10 by using a wiper 39. The cap 13 can be made of an elastic rubber material to secure and seal by adhering to the discharge port face. The wiper 39 is made of elastic material such as board-shaped rubber. Both of them are movably installed to contact and separate apart with respect to the discharge port face of the recording head 10.

The ink jet recording apparatus of the present invention has the plurality of discharge port arrays, which are part of the recording unit along with the plurality of ink tanks for supplying ink to each of the discharge port arrays so that each of the plurality of ink tanks are independently exchangeable. The ink jet recording apparatus records by discharging ink from the discharge port arrays to the recording material. The apparatus includes at least one cap for capping the plurality of discharge port arrays; a negative pressure generating unit connected to the cap; an ink tank exchange detecting unit for separately detecting each of the plurality of ink tanks exchanged, wherein the cap and the negative pressure generating unit are used to carry out a suction recovery operation for sucking ink from the plurality of discharge port arrays after exchanging the ink tank, and the conditions of the suction recovery operation are changed depending on the ink tank exchanged.

First Embodiment

Figure 3:
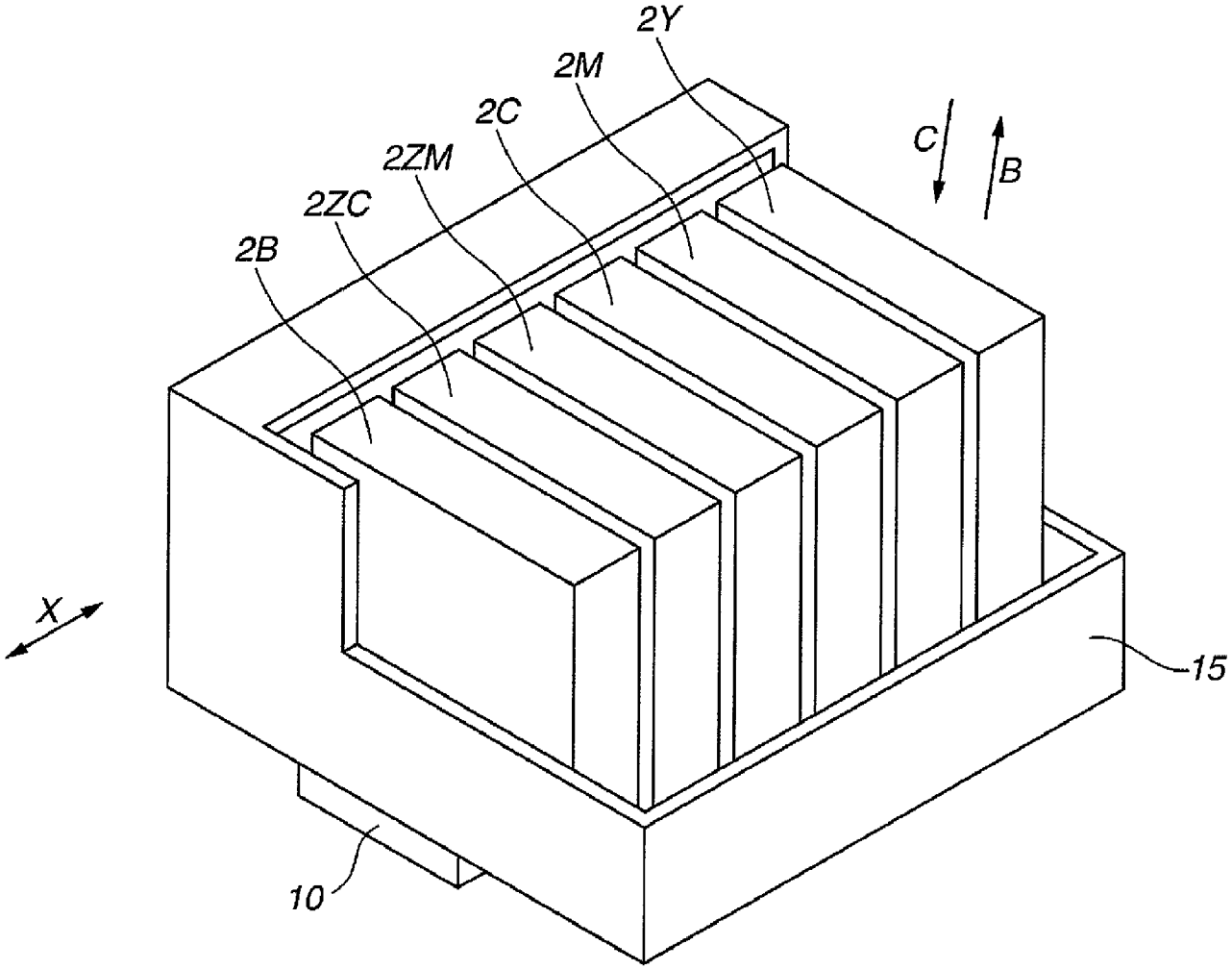
FIG. 3 is a perspective view of the ink tanks and recording unit shown in FIG. 2.

FIG. 2 is a schematic longitudinal sectional view of the suction recovery unit in accordance with the first embodiment of the present invention. FIG. 3 is a perspective view of the ink tanks and a recording head shown in FIG. 2. Referring to FIGS. 2 and 3, the recording head 10 includes the black ink discharge port array 1B, the light cyan ink discharge port array 1ZC, the light magenta ink discharge port array 1ZM, the cyan ink discharge port array 1C, the magenta ink discharge port array 1M, and the yellow ink discharge port array 1Y. Inside the recording head 10, the ink flow ducts 3 connected to each of the discharge port arrays are independently formed. That is, a black ink flow duct 3B, a light cyan ink flow duct 3ZC, a light magenta ink flow duct 3ZM, a cyan ink flow duct 3C, a magenta ink flow duct 3M, and a yellow ink flow duct 3Y are separately formed. At the uppermost position of each of the ink flow ducts are install filters 4B, 4ZC, 4ZM, 4C, 4M and 4Y to prevent dust from entering the ink flow ducts.

The recording head 10 equips the ink tanks 2 which are independently exchangeable, for supplying ink to the discharge port arrays 1 through the ink flow ducts 3. In other words, six ink tanks including a black ink tank 2B, a light cyan ink tank 2ZC, a light magenta ink tank 2ZM, a cyan ink tank 2C, a magenta ink tank 2M, and a yellow ink tank 2Y are exchangeable, and they are also independently mounted to the recording head 10. Inside the ink tanks 2, ink absorbers 5 (5B, 5ZC, 5ZM, 5C, 5M and 5Y) are installed for maintaining ink inside the ink tanks 2 at the pre-determined pressure. When the ink tank 2 is set in position, the ink absorber 5 touches the filter 4 installed at the entrance of the ink flow duct 3 of the recording head 10, and the ink inside the ink tank 2 is supplied to the ink flow duct 3.

The ink tank 2 is removed in a direction of the arrow B of FIG. 3. To set the ink tank 2 in position, it is inserted in a direction of the arrow C of FIG. 3. The fact that the ink tank exchange has taken place is detected by the ink tank exchange detecting unit (not illustrated). The ink tank exchange detecting unit can detect separately which ink tank had been exchanged. Examples of the desirable detection method of the ink tank exchange are: a detection method using an optical sensor of the permeable type or reflection type; a detection method using the optical sensor by operating the mechanical lever; and an electrical detection method using the electrical connection.

The operation and structure of the suction recovery unit of the recording head 10 will be explained below. Referring to FIG. 2, the cap 13 is prepared for sealing by adhesion to the discharge port arrays 1, which is movable in the directions of adhesion and separation with respect to the discharge port face of the recording head 10. In the first embodiment, six discharge port arrays 1 are structured to be sealed altogether by the single cap 13. Inside of the cap 13 is connected to the suction pump 14 as the negative pressure generating unit via a tube 8. The lowermost side of the suction pump 14 is connected to a waste ink processing component 12 via a tube 11.

During a recording operation, bubbles may be generated inside the ink flow duct 3 of the recording head 10. Also, during the ink tank exchange, bubbles may be introduced inside the ink flow duct 3 and causing air bubble generation inside the ink flow duct 3. Because of this, the suction recovery operation is performed in order to expel the air bubbles generated inside the ink flow duct 3. During the suction recovery operation, the ink from the discharge port arrays 1 is forcefully discharged therefrom by operating the suction pump 14 at the sealed state of the discharge port arrays 1 with the cap 13. Because of this, bubbles generated inside the ink flow duct 3 are expelled together with the ink, and the bubbles inside the ink flow duct 3 can be removed accordingly.

The volume of the ink flow ducts 3 is explained below. As shown in FIG. 2, the lengths of the ink flow ducts 3 are not all same, and the dimensions of the lengths and volume of ink the flow ducts have the relationship: 3ZM<3C<3ZC<3M<3B<3Y. If an ink tank 2 is being exchanged, the bubble inclusions are anticipated inside the ink flow duct 3. Thus, in order to remove the bubbles inside the ink flow duct 3 to charge up the ink flow duct 3 to the ink filled-state, an approximately equal amount of ink as the ink flow duct volume should be sucked. In this case, if the yellow ink tank 2Y corresponding to the yellow flow duct 3Y having the maximum volume is being exchanged, then an amount of the ink six times the volume of the ink flow duct 3Y may be discharged by suction.

Moreover, in the case of exchanging the light magenta ink tank 2ZM corresponding to the ink flow duct 3ZM having the minimum flow duct volume, an amount of the ink six times the volume of the ink flow duct 3ZM should be discharged by suction. Likewise, in exchanging other ink tanks 2, the suction amounts are separately set depending on the volume of the corresponding ink flow ducts. Then, as for the ink jet recording apparatus and its suction recovery method of the present invention, so as to satisfy these requirements, upon sucking the ink from the plurality of discharging port arrays by using the cap 13 and the suction pump 14 after exchanging the ink tank, the conditions of the suction operation are changed depending on the exchanged ink tank. In particular, according to the first embodiment, the conditions of the suction operation are changed depending on the volume of ink flow duct corresponding to the exchanged ink tank.

The conditions of the suction operation, for example, is executed by changing the amount of ink suction from the discharge ports 1. Moreover, since a difference in the ink flow resistance is generated depending on the ink property and the ink flow duct structure, the appropriate conditions of suction operation after the ink tank exchange for each of the ink tanks 2 is set, and that requires not only the suction amount setting change, but also some changes in the operation conditions such as negative pressure duration, maximum negative pressure value, and negative pressure occurrences. Examples of the changes in the operation condition setting includes: a method of changing the amount of negative pressure change of the suction pump 14; a method of controlling the negative pressure value of the suction pump 14; and a method of changing the negative pressure duration, the maximum negative pressure value, or the negative pressure occurrences. As explained in the above structure, a highly efficient recovery operation without wasting ink more than necessary is possible, to reduce the amount of ink discharge during the ink tank exchange and the suction process. In this way, it becomes possible to implement the compact apparatus by reducing the size and the cost of the waste ink processing component.

Second Embodiment

Figure 4:
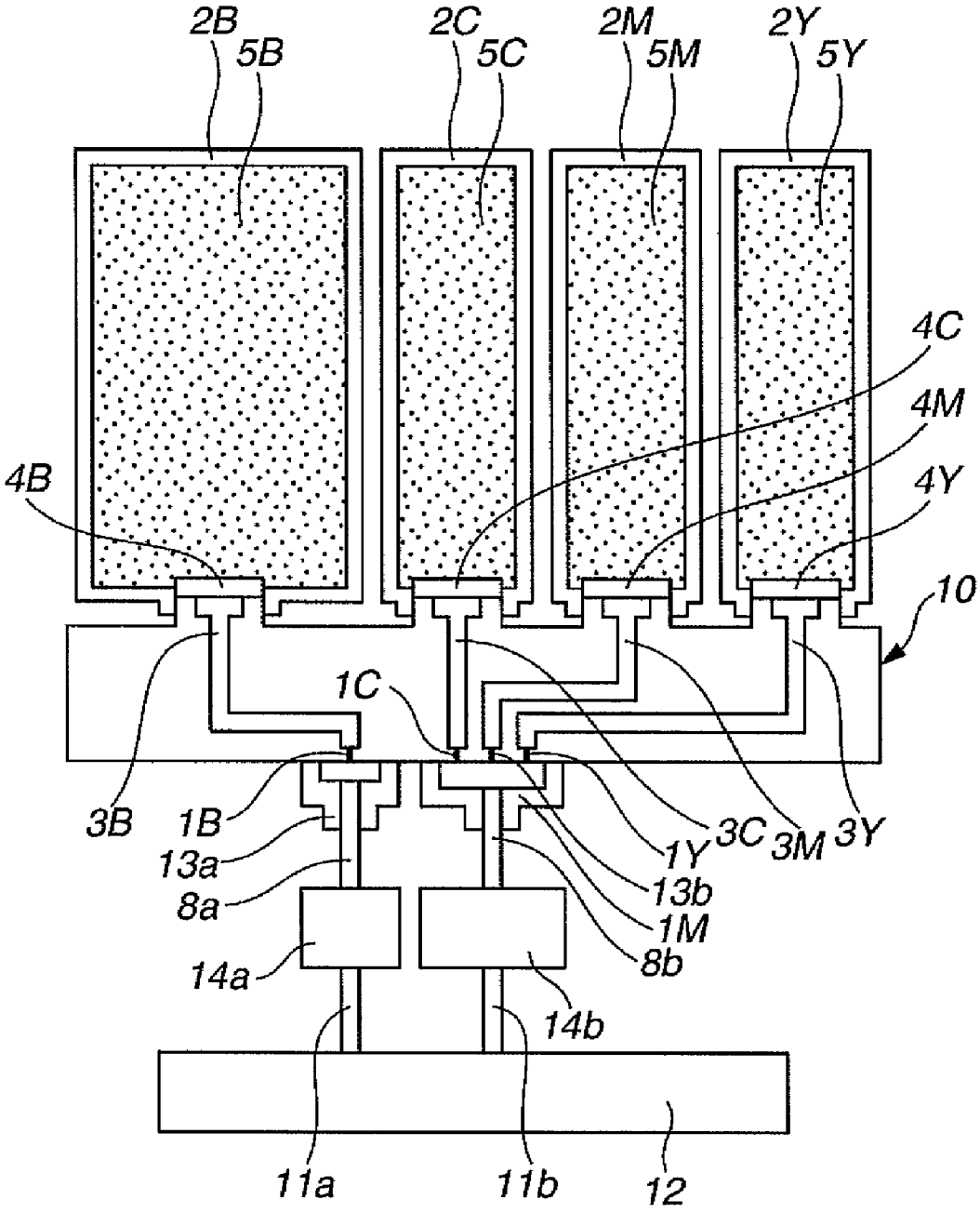
FIG. 4 is a schematic longitudinal sectional view showing the suction recovery unit in accordance with a second embodiment of the present invention.

FIG. 4 is a schematic longitudinal sectional view of the suction recovery unit in accordance with the second embodiment of the present invention. In the first embodiment, performing the suction recovery used six discharge port arrays 1 that discharge different inks and sealed by the single cap 13. Alternatively, as shown in FIG. 4, four discharge port arrays of the recording head 10 are capped by two caps 13*a* and 13*b*, and two suction pumps 14*a* and 14*b* perform the suction recovery.

Referring to FIG. 4, the cap 13*a* caps the black ink discharge port array 1B, and the cap 13*b* caps the colored ink discharge port arrays 1C, 1M and 1Y. Suction of the black ink discharge port array 1B is performed by the suction pump 14*a* via the cap 13*a*. Suction of the colored ink discharge port arrays 1C, 1M, and 1Y is performed by the suction pump 14*b* via the cap 13*b*. The suction pump 14*a* is connected to the waste ink processing component 12 and the cap 13*a* through tubes 8*a* and 11*a*. The suction pump 14*b* is connected to the waste ink processing component 12 and the cap 13*b* through tubes 8*b* and 11*b*.

The recording head 10 is equipped with the black ink tank 2B, the cyan ink tank 2C, the magenta ink tank 2M and the yellow ink tank 2Y, which are independently exchangeable. The ink is supplied to the corresponding discharge port arrays through the corresponding ink flow ducts 3B, 3C, 3M and 3Y. Among the plurality of colored ink tanks, if the yellow ink tank 2Y is being exchanged corresponding to the ink flow duct 3Y having the maximum volume, similar to the case of the first embodiment, an amount of ink which is almost equivalent to three times the volume of the ink flow duct 3Y (flow capacity) may be sucked and discharged. If the cyan ink tank 2C is being exchanged corresponding to the ink flow duct 3C having the minimum volume, an amount of ink which is almost equivalent to three times the volume of the ink flow duct 3C can be sucked and discharged.

In the second embodiment, so as to satisfy these conditions, after exchanging a colored ink tank, upon sucking the ink from the plurality of colored ink discharge port arrays 1, the conditions of suction operation are changed depending on the volume of the ink flow duct corresponding to the exchanged ink tank. Only this point mentioned above in the second embodiment is different from the first embodiment, and both substantially have the same structure. The equivalent elements are indicated by the same reference characters, so the detailed explanation is omitted. Moreover, in the second embodiment, since a difference in the ink flow resistance is generated depending on the difference in the ink property and the ink flow duct structure, the appropriate conditions of suction operation after the ink tank exchange for each of the ink tanks is set, and that require not only the suction amount setting change, but also some changes in the operation conditions such as negative pressure duration, maximum voltage value, and negative pressure occurrences.

Figure 9:
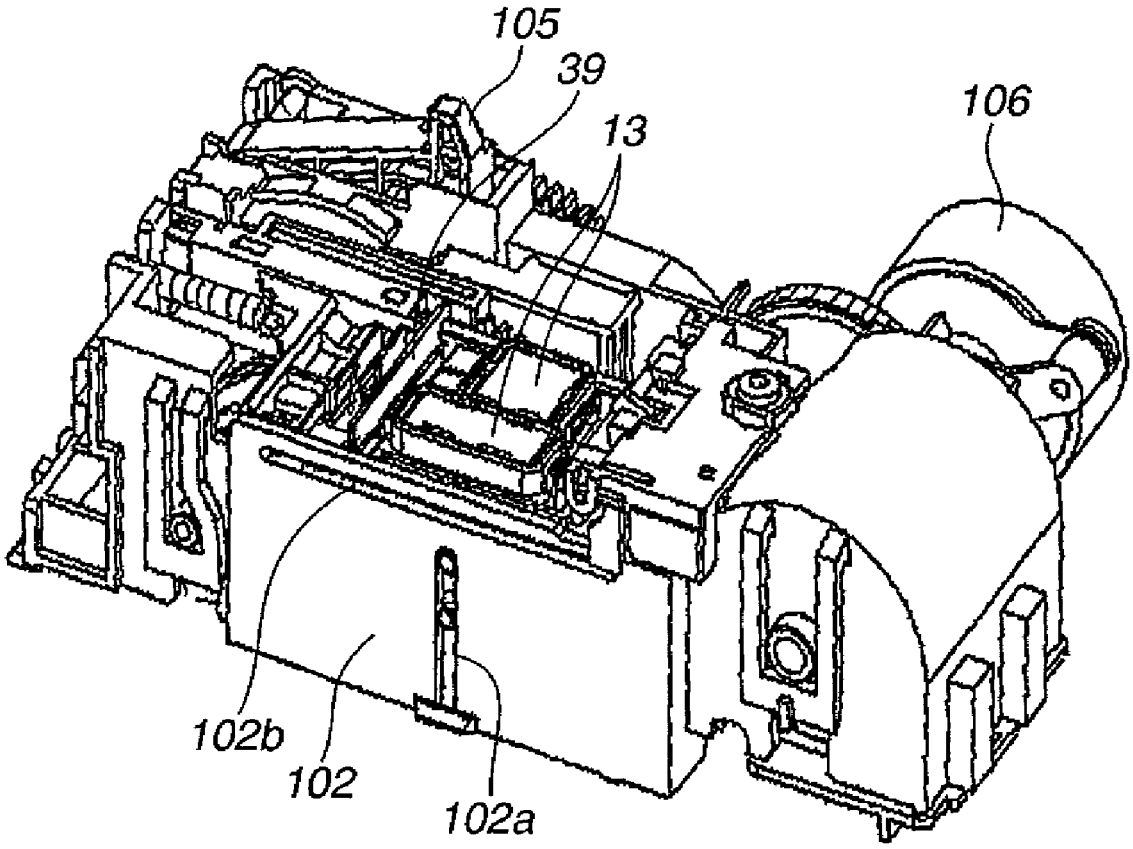
FIG. 9 is an oblique view showing a recovery unit in accordance with the second embodiment of the present invention.
Figure 10:
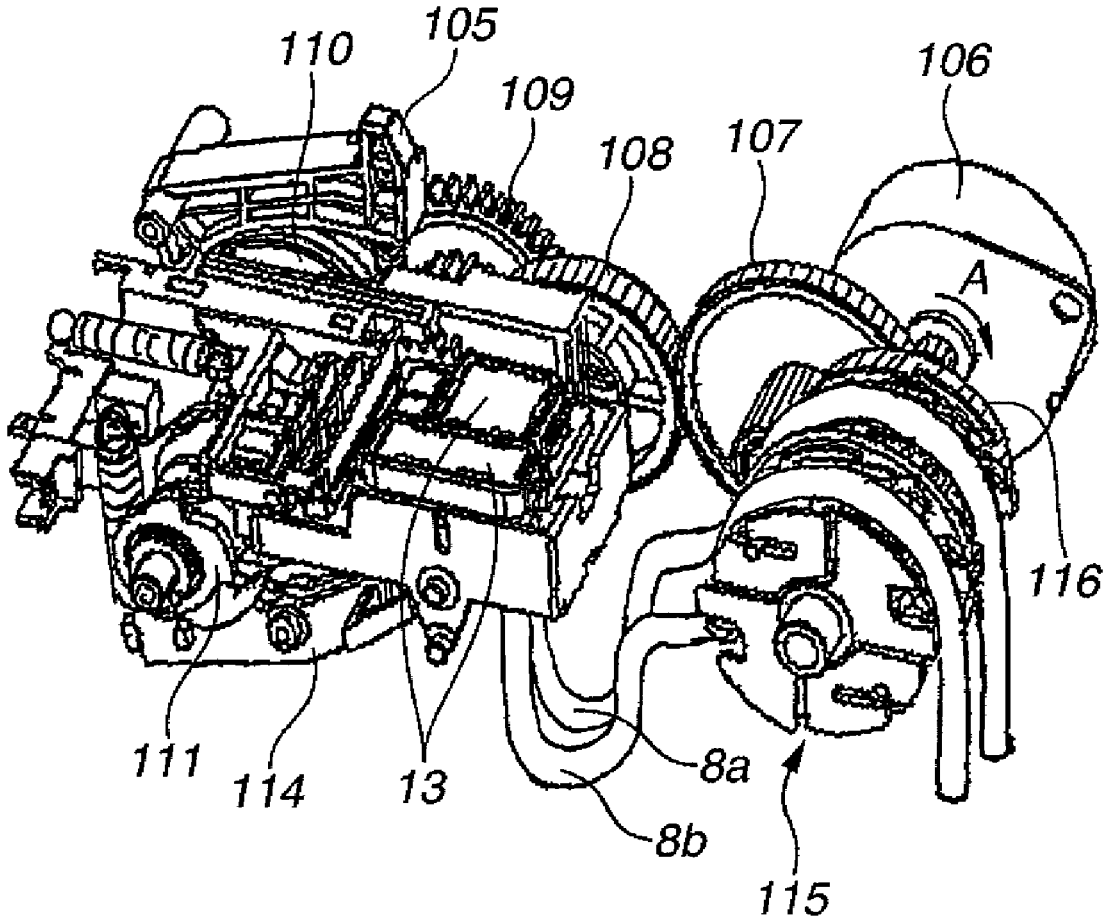
FIG. 10 is an oblique view showing an interior of the recovery unit of FIG. 9.

FIG. 9 is an oblique view showing a recovery unit 50 in accordance with the present embodiment. FIG. 10 is an oblique view showing an interior of the recovery unit 50 of FIG. 9. Referring to FIGS. 9 and 10, the recovery unit 50 comprises: a cap 13 which is installed to move up and down along a guide 102*a* of a base 102, for covering a discharge port face of the recording head 10; a wiper 39 which is installed to move back and forth along a guide 102*b*, for wiping the discharge port face of the recording head 10; and locking means 105 for retaining the carriage 15 from moving while the discharge port face is being capped.

The cap 13, the wiper 39, and the locking means 105 operate by a driving force transmitted from a motor 106 through gears 107, 108 and 109. Rotating a main cam 111 in one direction of the motor 106, via a one-way crutch gear 110 carries out their operation. That is, a plurality of cams is formed in an elongated direction of the main cam 111. The rotation of the main cam 111 is converted to a rotation of the locking means 105 by a single cam. Also, the rotation of the main cam 111 is converted to linear back and forth motions of the wiper 39 by an another cam, rack and pinion, and the like. Further, the rotation of the main cam 111 is converted to up and down movements of the cap 13 by an another cam and a lever 14.

The cap 13 shown in the drawing is an integral type having two rooms. Tubes 8*a* and 8*b* are connected to each of the two rooms. Each of the tubes 8*a* and 8*b* is disposed along a circular arc guide face which is formed on a part of the base 102. The tube pump is configured accordingly as the suction means. The waste ink sucked from the discharge port of the recording head 10 is expelled from the other end of the tubes 11*a* and 11*b*.

Figure 11:
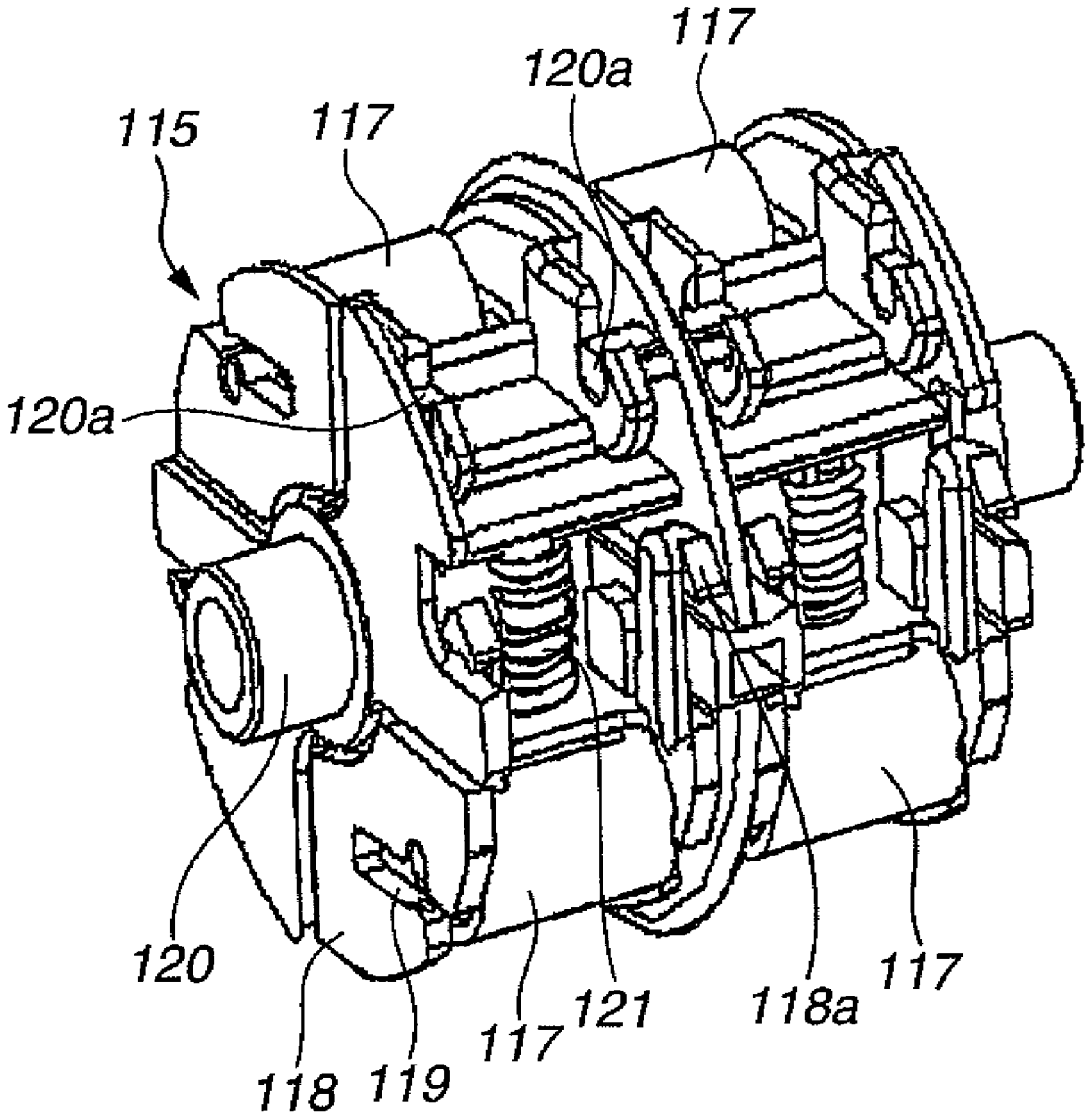
FIG. 11 is an oblique view showing a structure of roller holding means of the tube pump.

FIG. 11 is an oblique view showing a structure of roller holding means of the tube pump. The roller holding means 115 having the same line of axis as the center of the circular arc guide face of the base 102 is rotably disposed at the interior of the base 102. On the roller holding means 115, two rollers 117 are disposed in a circumference direction, and four rollers 117 are arranged in parallel in an axial direction, corresponding to the two tubes 8*a* and 8*b* and are pivotally supported. The roller holding means 115 is rotated by transmitting the drive of the motor 106 via the gear 107 to a pump gear 116 positioned at one end of the roller holding means 115. In this way, the suction force is generated while pressing and squeezing the tubes 8*a* and 8*b* with the roller 117.

According to the present embodiment, the rotation of the roller holding means 115 in one direction allows the ink suction by pressing the tubes 8*a* and 8*b* with the rollers 117. In other words, the tube pump operates when the motor 106 rotates in a direction of the arrow A. At this time, the one-way crutch gear 110 is idle, and the main cam 11 does not rotate, and thus the cap 13, the wiper 39, and the locking means 105 remain stopped. On the other hand, if the motor 106 rotates in a reverse direction, the cap 13, the wiper 39, and the locking means 105 operate in a specified timing. At this time, the rollers 117 release the pressing of the tubes 8*a* and 8*b*, and the tube pump does not operate.

A structure of the tube pump will be explained below in detail. Referring to FIG. 11 showing the structure of roller holding means 115, each roller 117 is held in its position by a guiding gutter 119 of a roller holder 118. The roller holder 118 is swingably mounted by centering a fulcruming axis 120*a* with respect to a rotation board 120. The swingable roller holders 118 are compelled in one direction by springs 121. That is, the rollers 117 press the tubes 8*a* and 8*b* with compelling forces of the springs. The roller holder 118 is held where a stopper 118*a* is engaged to a part of the rotation board 120 at a position which does not correspond to the tubes 8*a* and 8*b*. In the present embodiment, 4 sets including the roller 117 and the roller holder 118 have been prepared, and these sets are attached to the rotation board 120. In this way, two rollers can press each of the tubes 8*a* and 8*b*.

In this configuration, the ink suction amount change will be described. In a first method, by changing a distance for pressing the tube 8 by the roller 117 the ink suction amount is changed. When increasing the ink suction amount, an angle of rotation of the pump is increased, and the distance for pressing and squeezing the tube 8 by the roller 117 is increased. On the other hand, when decreasing the ink suction amount, the angle of rotation of the pump is decreased, and the distance for pressing and squeezing the tube 8 by the roller 117 is decreased.

In a second method, by changing the suction occurrences of the pump the ink suction amount is changed. The suction amount is selectively changed by setting a single suction mode that carries out only one pump operation and a plural suction mode that carries out plural pump operations. In a third method, by changing the negative pressure by leaking a very small amount of air from an air-communication valve the ink suction amount is changed during the suction operation.

Further, in a fourth method, upon sucking ink from the discharge port of the recording head 10, the suction amount can be changed by operating the suction pump, and terminating the roller 117, depending on the case of keeping the capped state until fully depressurized, or the case of releasing the capped state before depressurizing or communicating air through the air-communication valve. Moreover, in a fifth method, the ink suction amount can be changed by changing a rotation speed of the suction pump.

Furthermore, the ink suction amount can be changed by appropriately combining the first to fifth methods.

Third Embodiment

Figure 5:
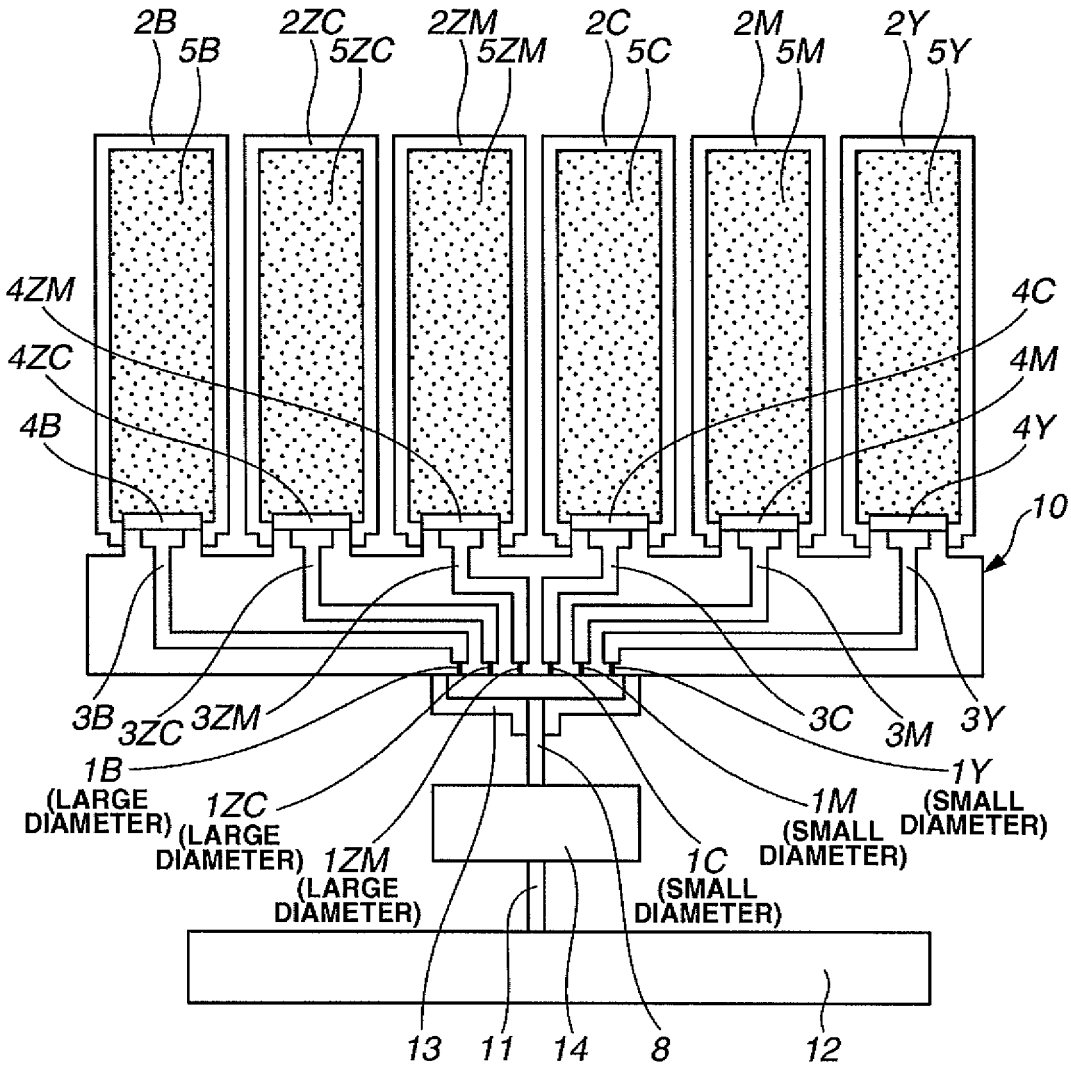
FIG. 5 is a schematic longitudinal sectional view showing the suction recovery unit in accordance with a third embodiment of the present invention.

FIG. 5 is a schematic longitudinal sectional view of the suction recovery unit in accordance with the third embodiment of the present invention. The first and second embodiments illustrate the case of using the discharge port arrays with the same diameter for all of the discharge port arrays 1. Alternatively, discharge ports with different diameters may be constructed. Generally, in the ink jet recording apparatus, since highly concentrated ink tends to show prominent granularity, the discharge port diameters are changed depending on the type of ink for a purpose of setting the dot diameter small. According to the third embodiment, the discharge port diameters of the cyan ink discharge port array 1C, the magenta ink discharge port array 1M, and the yellow ink discharge port array 1Y are set smaller than the discharge port diameters of the black ink discharge port array 1B, the light cyan ink discharge port array 1ZM and the light magenta ink discharge port array 1ZM.

To perform the suction recovery operation to the recording head 10 having a plurality of discharge port arrays with different diameters such as these, a difference in the suction amounts is generated due to the different diameters of the discharge port arrays even if the same negative pressure is applied via the cap 13. That is, the ink flow resistance tends to get large for a small diameter discharge port, and the ink discharge amount of a large diameter discharge port tends to get less. In the structure of FIG. 5, the lengths and volume of the ink flow ducts are symmetrically arranged, and has a relationship of 3C=3ZM<3M=3ZC<3Y=3B. The ink flow ducts 3C and 3ZM have the same length and volume, so that if the diameters of the discharge port arrays 1C and 1ZM are the same, the suction amounts upon the ink tank exchange and the conditions for the suction operation can also be the same. However, in the example of the third embodiment, the diameters of the discharge port arrays 1C and 1ZM are different, a suction amount of the cyan ink having the small diameter discharge port should be larger than a suction amount of the light magenta ink having the large diameter discharge port.

Similarly, a suction amount of the magenta ink should be set greater than a suction amount of the light cyan ink. A suction amount of the yellow tank should also be set greater than a suction amount of the black ink. Moreover, in the third embodiment, since a difference in the ink flow resistance is generated depending on the difference in the discharge port diameters, the appropriate conditions of suction operation after the ink tank exchange for each of the ink tanks is set, and that requires not only the suction amount setting change, but also some changes in the operation conditions such as negative pressure duration, maximum negative pressure value, and negative pressure occurrences. Although the third embodiment differs from the first embodiment in the point described above, it substantially has the same structure. The equivalent elements are indicated by the same reference numerals, so the detailed explanation is omitted. Henceforth, according to the third embodiment, even in the case of discharging the ink from the discharge ports of the different diameters, a highly efficient recovery operation is possible by reducing the operating cost without wasting the ink to implement the compact apparatus by reducing the size and the cost of the waste ink processing component.

Fourth Embodiment

Figure 6:
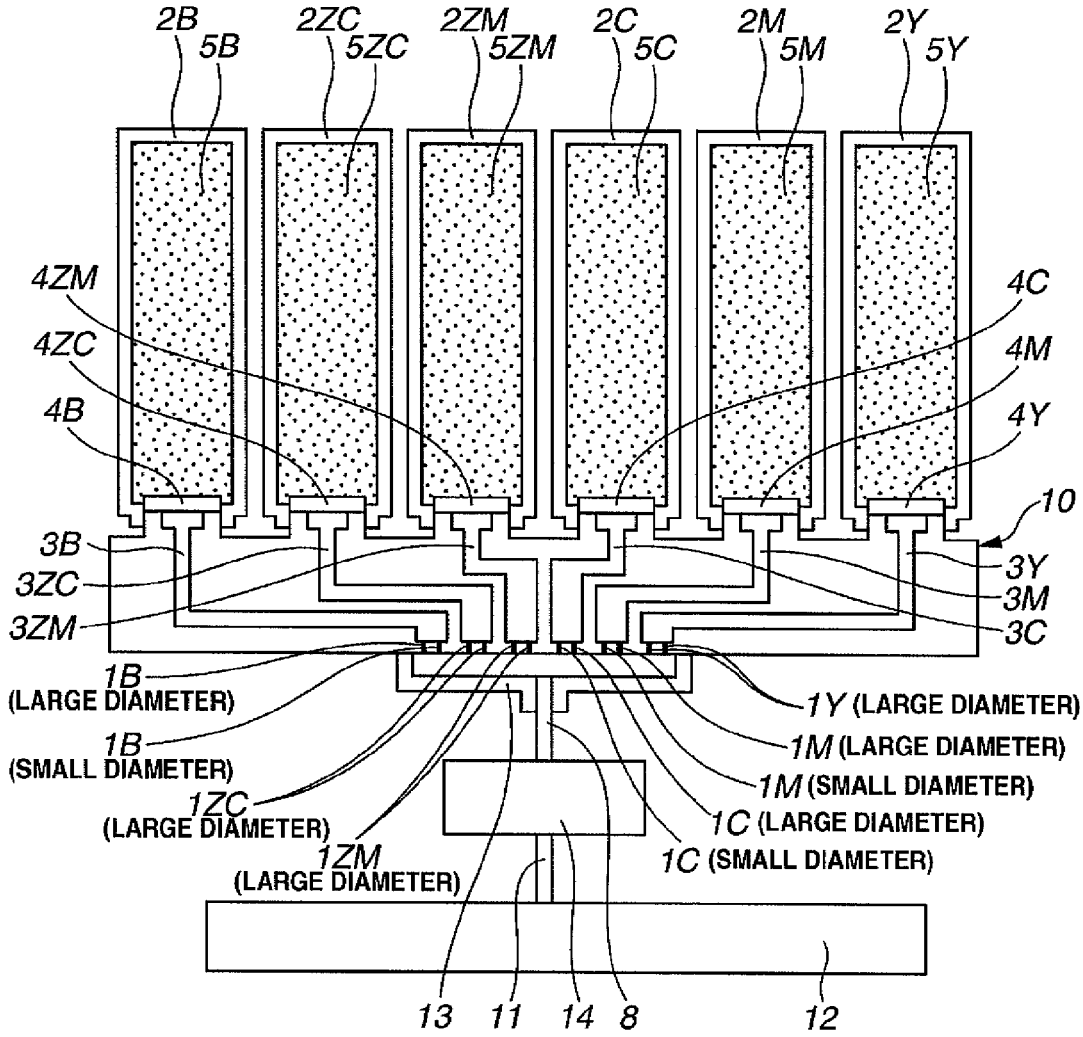
FIG. 6 is a schematic longitudinal sectional view showing the suction recovery unit in accordance with a fourth embodiment of the present invention.

FIG. 6 is a schematic longitudinal sectional view of the suction recovery unit in accordance with the fourth embodiment of the present invention. The previously described third embodiment has explained the case of the different discharge port diameters, however, there is also the case in which a plurality of discharge port arrays with different discharge port diameters that discharge the same ink. In other words, according to an ink jet recording apparatus of the fourth embodiment, the same ink is discharged from the plurality of discharge port arrays with different diameters.

Referring to FIG. 6, discharge port arrays of the black ink 1B, the cyan ink 1C, and the magenta ink 1M are composed of two (2) lines of discharge port arrays composed of a large diameter discharge port array and a small diameter discharge port array. On the other hand, discharge port arrays of the light cyan ink 1ZC, the light magenta ink 1ZM, the yellow ink 1Y are composed of two (2) lines of discharge port arrays composed only of the large diameter discharge port arrays. In order to perform the suction recovery operation to the recording head having such discharge port arrays, a difference in the suction amounts may be generated due to the difference in the discharge port diameters even if the same negative pressure is applied. In other words, the ink flow resistance in the small diameter discharge port gets large, and an amount of ink discharge of the small diameter discharge port tends to get less compared to those of the large diameter discharge port.

According to the fourth embodiment, similar to the cases of FIG. 5, the ink flow duct lengths and the volumes are symmetrically arranged, and has a relationship of 3C=3ZM<3M=3ZC<3Y=3B. However, in the fourth embodiment, as for the ink flow ducts 3C and 3ZM, their corresponding two discharge port arrays do not have the same diameter, such that a suction amount of the cyan ink C having two (2) lines of discharge port arrays having different diameters should be greater than a suction amount of the light magenta ink ZM having two (2) lines of large diameter discharge port arrays. Likewise, a suction amount of the magenta ink M should be greater than a suction amount of the light cyan ink ZC. A suction amount of the black ink B should be greater than a suction amount of the yellow ink Y.

Although the fourth embodiment is different from the first to third embodiments in the described points, it substantially has the same structure. Moreover, according to the fourth embodiment, since a difference in the ink flow resistance is generated depending on the discharge port diameters, the appropriate conditions of suction operation after the ink tank exchange for each of the ink tanks 2 is set, and that requires not only the suction amount setting change, but also some changes in the operation conditions such as negative pressure duration, maximum negative pressure value, and negative pressure occurrences. Henceforth, according to the fourth embodiment, even in the case of discharging the ink from the discharge port arrays having different diameters for the same ink, it is possible to perform a highly efficient recovery operation reducing the operating cost without wasting the ink to implement the compact apparatus by reducing the size and the cost of the waste ink processing component.

Fifth Embodiment

Figure 7:
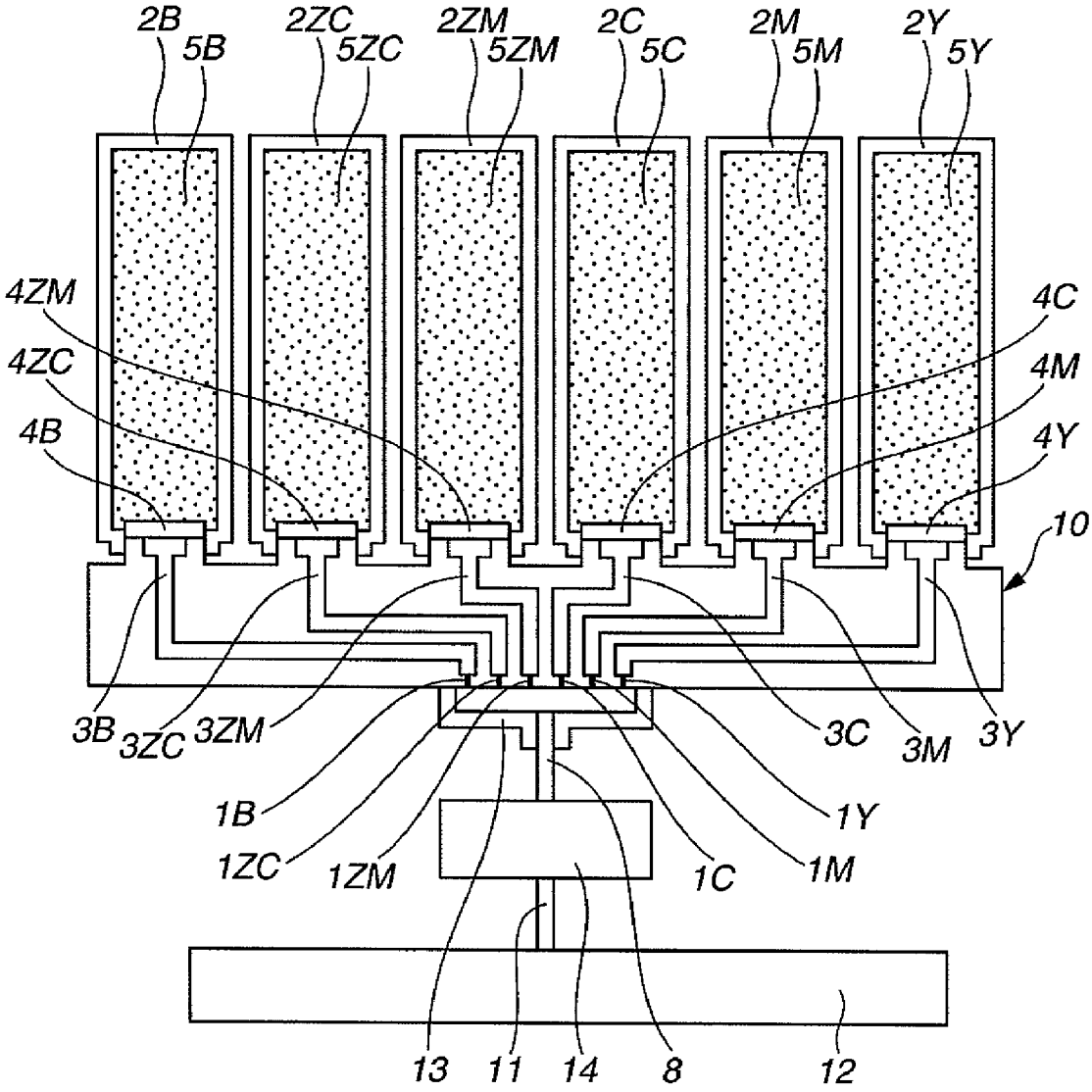
FIG. 7 is a schematic longitudinal sectional view showing the suction recovery unit in accordance with a fifth embodiment of the present invention.

FIG. 7 is a schematic longitudinal sectional view of the suction recovery unit in accordance with the fifth embodiment of the present invention. In the previously described first embodiment, the suction recovery unit is configured to change the conditions of suction operation and the suction amount for every corresponding discharge port, depending on the volume and lengths of the ink flow ducts 3 of the recording head 10. However, there are cases in which the ink suction amounts are changed depending on the ink composition despite of the fact that the ink flow capacity remains the same. This is because a difference in the flow resistance is generated which is caused by a difference in the viscous resistance of the different ink compositions. The characteristic of the fifth embodiment lies in the fact that the conditions of suction recovery operation can be changed depending on the exchanged ink tanks under such circumstances.

Similar to the case of FIG. 5, according to the fifth embodiment, as shown in the drawing, the lengths and volume of the ink flow ducts are symmetrically arranged, and has a relationship of 3C=3ZM<3M=3ZC<3Y=3B. In other words, the ink flow duct lengths, the ink flow duct volume, and the discharge port diameters of the corresponding discharge port arrays are the same for the following pairs: cyan ink C and light magenta ink ZM; magenta ink M and cyan ink C; and yellow ink Y and black ink B. Accordingly, the conditions of suction operation can be the same if the ink composition is same as in each of the pairs above. However, if the ink composition differs, then the suction amount of the discharge port of ink with high viscous resistance must be large. In other words, to generate a difference in the ink viscous resistance, the conditions of suction recovery operation is changed and controlled depending on the color of the exchanged ink tank.

Moreover, according to the fifth embodiment, the appropriate conditions of suction operation after the ink tank exchange for each of the ink tanks 2 is set, and that requires not only the suction amount setting change, but also some changes in the operation conditions such as negative pressure duration, maximum negative pressure value, and negative pressure occurrences. Henceforth, according to the fifth embodiment, even in the case of discharging the ink having different compositions from the discharge ports, a highly efficient recovery operation is possible by reducing the operating cost without wasting the ink to implement the compact apparatus by reducing the size and the cost of the waste ink processing component.

Sixth Embodiment

Figure 8:
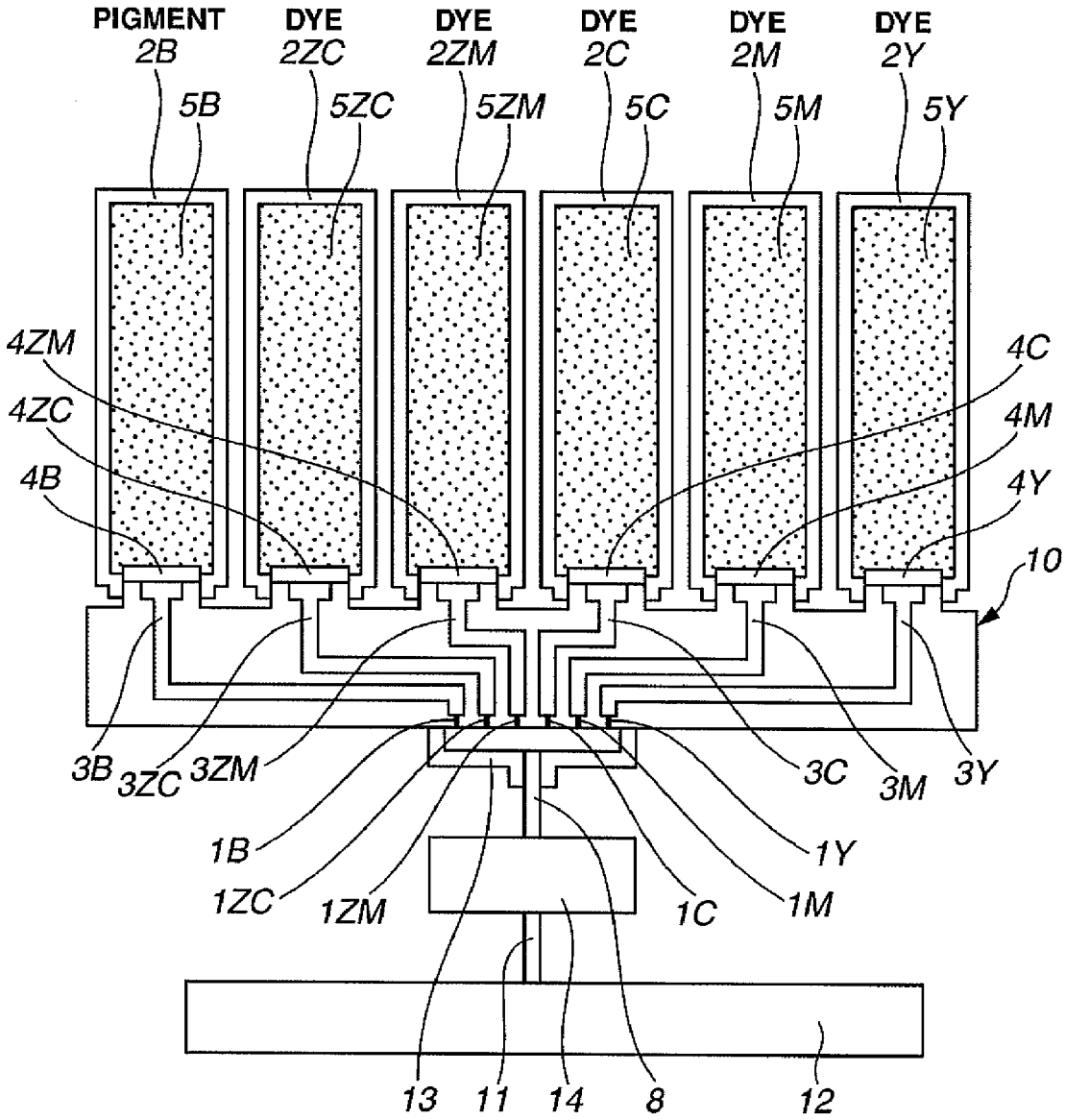
FIG. 8 is a schematic longitudinal sectional view showing the suction recovery unit in accordance with a sixth embodiment of the present invention.

FIG. 8 is a schematic longitudinal sectional view of the suction recovery unit in accordance with the sixth embodiment of the present invention. According to the assumption being made in the previously described first embodiment, the case of discharging the dye ink from each of the discharge port arrays has been explained. There is also the case in which both the dye ink discharge port arrays and the pigment ink discharge port arrays are present among the plurality of discharge port arrays, which are sealed by a single cap 13. This is the case in which the ink suction amounts change depending on whether the ink is a pigment ink or a dye ink. This is because the pigment ink in general tends to have a higher viscous resistance than the dye ink to generate a difference in the suction amounts due to a difference in the viscous resistance.

The characteristic of the sixth embodiment lies in the fact that the conditions of suction recovery operation can be changed depending on the type of exchanged ink tank, whether it is of a dye ink or a pigment ink. Referring to FIG. 8, the black ink B is a pigment ink, and the other colored inks ZC, ZM, C, M and Y are dye ink. Since the pigment ink tends to raise the viscous resistance, upon exchanging them, a suction amount of the black ink tank must be greater than the suction amounts of the colored ink tanks, provided that the diameters of the discharge ports and the volumes of ink flow ducts are the same for both black ink and the colored ink.

Moreover, according to the sixth embodiment, the appropriate conditions of suction operation after the ink tank exchange is set, and that requires not only the suction amount setting change, but also some changes in the operation conditions such as negative pressure duration, maximum negative pressure value, and negative pressure occurrences. Henceforth, according to the sixth embodiment, even in the case of exchanging the plurality of ink tanks at the same time, a highly efficient recovery operation is possible by reducing the operating cost without wasting the ink to implement the compact apparatus, and by reducing the size and the cost of the waste ink processing component.

Seventh Embodiment

According to the assumption being made in the previously described first to sixth embodiments, they explain the cases of exchanging only one ink tank. However, the present invention is similarly applicable to the cases of exchanging a plurality of ink tanks at the same time and still being able to bring about the similar effect. In this case, among the plurality of ink tanks exchanged, the ink tank with the highest conditions of the suction operation is set as the standard to carry out the corresponding suction operation of the ink tank. According to the seventh embodiment of the present invention, even though the plurality of ink tanks is being exchanged at the same time, the highly efficient recovery operation is possible without wasting the ink. This brings about the effectiveness of reducing the operating cost, at the same time, making it possible to implement the compact apparatus by reducing the size and the cost of the waste ink processing component.

Eighth Embodiment

According to the previously described first to sixth embodiments, depending on the difference in the elements such as ink type, ink composition, discharge port diameters, and ink flow duct volume, although the suction operation conditions are set for every exchanging of the ink tank, however, these elements may be adopted separately, or, two or more elements may be combined. Furthermore, the above embodiments are the cases of using four and six ink tanks that are separately exchangeable. However, the number of the ink tanks is not limited. The present invention is applicable for any cases of ink tanks of two or more. Moreover, the present invention is applicable to any cases of adding a special color ink tank such as red ink, blue ink, green ink and gray ink, as long as the ink tanks are plural, to exhibit the similar effect. Furthermore, in general, the greater the number of ink tanks, the larger the differences in the lengths and volumes of the ink flow ducts, so that the present invention becomes much more effective. Moreover, the present invention is similarly applicable to the case of using all pigment ink to bring about the similar effects.

Further, the serial recording method of the ink jet recording apparatus for recording by moving the recording head relative to the recording material, is given as an example in the above embodiments. However, the present invention is similarly applicable to the line recording method of the ink jet recording apparatus for recording only by sub scans by using a line type recording head having a length that covers a part or a whole width of the recording material. Moreover, the present invention is similarly applicable for the following cases: a recording apparatus using a single recording head; a color recording apparatus using a plurality of recording heads for recording by using different colored ink; a tone gradation recording apparatus using a plurality of recording heads for recording in different concentration by using the same color; and a recording apparatus that combines these cases. The similar effects are achievable.

Further, the ink jet recording apparatus of the present invention is applicable in the case of utilizing the recording unit that uses the electrothermal converting element such as piezo actuator, to bring about the excellent effect to the ink jet recording apparatus that adopts the recording unit of the ink discharge method using a thermal energy. The method accordingly achieves a high recording density and a high resolution.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink jet recording apparatus, comprising:

a carriage mounting a recording head having a discharge port portion and a plurality of ink tanks including a first ink tank and a second ink tank each containing ink, the recording head further having a first ink duct connecting the first ink tank to the discharge port portion and a second ink duct connecting the second ink tank to the discharge port portion, wherein length or volume of the first and second ink ducts are different with each other;

a cap operable to cap the discharge port portion; and a generating unit connected to the cap, operable to suck ink from the discharge port portion by supplying negative pressure inside the cap capping the discharge port portion after one of the first and the second ink tanks is exchanged, wherein an amount of suction inside the cap capping the discharge port portion is changed depending on the length or the volume of one of the first and the second ink ducts corresponding to one of the first and the second ink tanks being exchanged.

2. An ink jet recording apparatus according to claim 1, wherein the amount of suction is changed by controlling at least one of a generating amount of the negative pressure, a generating occurrence of the negative pressure, a maximum amount of the negative pressure, and a duration of the negative pressure, generated by the generating unit.

3. An ink jet recording apparatus according to claim 1, wherein in a case both the first and the second ink tanks are exchanged and the first ink tank requires higher amount of suction than the second ink tank, the generating unit is controlled to supply the amount of suction required by the first ink tank.

4. An ink jet recording apparatus, comprising:

a carriage mounting a recording head having a first discharge port portion having a first diameter and a second discharge port portion having a second diameter different from the first diameter, and a plurality of ink tanks including a first ink tank and a second ink tank each containing ink, the recording head further having a first ink duct connecting the first ink tank to the first discharge port portion and a second ink duct connecting the second ink tank to the second discharge port portion;

a cap operable to cap the first and the second discharge port portions; and a generating unit connected to the cap, operable to suck ink from the discharge port portions by supplying negative pressure inside the cap capping the discharge port portions after one of the first and the second ink tanks is exchanged, wherein an amount of suction inside the cap capping the discharge port portions is changed depending on the diameter of one of the first and the second discharge port portion corresponding to one of the first and the second ink tanks being exchanged.

5. An ink jet recording apparatus, comprising:

a carriage mounting a recording head having a discharge port portion and a plurality of ink tanks including a first ink tank and a second ink tank each containing ink, the recording head further having a first ink duct connecting the first ink tank to the discharge port portion and a second ink duct connecting the second ink tank to the discharge port portion, wherein the first and the second ink tanks contain different type of ink with each other;

a cap operable to cap the discharge port portion; and a generating unit connected to the cap, operable to suck ink from the discharge port portion by supplying negative pressure inside the cap capping the discharge port portion after one of the first and the second ink tanks is exchanged, wherein an amount of suction inside the cap capping the discharge port portion is changed depending on the type of ink corresponding to one of the first and the second ink tanks being exchanged.

6. An ink jet recording apparatus, comprising:

a recording head having a discharge port portion;

a plurality of ink tanks including at least a first ink tank and a second ink tank each containing ink;

a first ink duct connecting the first ink tank to the discharge port portion and a second ink duct connecting the second ink tank to the discharge port portion, wherein length or volume of the first and second ink ducts are different with each other;

a cap operable to cap the discharge port portion; and a generating unit connected to the cap, operable to suck ink from the discharge port portion by supplying negative pressure inside the cap capping the discharge port portion after one of the first and the second ink tanks is exchanged, wherein an amount of suction inside the cap capping the discharge port portion is changed depending on the length or the volume of one of the first and the second ink ducts corresponding to one of the first and the second ink tanks being exchanged.

* * * * *